US005342064A

United States Patent [19]

Williamson et al.

[11] Patent Number: 5,342,064

[45] Date of Patent: Aug. 30, 1994

[54] ACQUISITION GAME

[75] Inventors: Craig Williamson; Mark Luecke; John R. Wildman, all of North Riverside; Dennis J. O'Patka, Chicago, all of Ill.

[73] Assignee: Western Publishing Co., Inc., Racine, Wis.

[21] Appl. No.: 142,585

[22] Filed: Oct. 25, 1993

[51] Int. Cl.[5] ..... A63F 9/00

[52] U.S. Cl. ..... 273/447

[58] Field of Search ..... 273/440, 441, 442, 445, 273/446, 447

[56] References Cited

U.S. PATENT DOCUMENTS

| | | | |
|---|---|---|---|
| 3,578,319 | 5/1971 | Kohner et al. . | |
| 3,857,569 | 12/1974 | Goldfarb et al. | 273/447 X |
| 4,177,987 | 12/1979 | Zimmerman | 273/447 X |
| 4,412,682 | 11/1983 | Rehkemper et al. | 273/447 |
| 4,813,670 | 3/1989 | Mizunuma | 273/447 |
| 4,838,553 | 6/1989 | Chaun-Tien | 273/447 |
| 4,863,164 | 9/1989 | Mizunuma | 273/447 |
| 4,900,026 | 2/1990 | Kulesza et al. | 273/447 X |
| 4,961,580 | 10/1990 | Yoe et al. | 273/447 |
| 5,028,047 | 7/1991 | Lee et al. | 273/447 |
| 5,102,148 | 4/1992 | Mizunuma | 273/447 |
| 5,190,298 | 3/1993 | Lee et al. | 273/447 X |
| 5,295,694 | 3/1994 | Levin | 273/447 |

*Primary Examiner*—William H. Grieb

*Attorney, Agent, or Firm*—Amster, Rothstein & Ebenstein

[57] ABSTRACT

An acquisition game is played on a concave playing field defining a nadir with a plurality of movable game pieces removably disposed on the field for movement thereabout. Each player has an acquisition tool for removing at least one of the game pieces at a time from the field, the acquisition tool also being for moving the game pieces and an interposing member about the field. An interposing member (preferably in the form of an animal such as a crab) is removably disposed on the field for movement thereabout when the interposing member vibrates. The interposing member is substantially greater in size than any of the game pieces and defines passages therethrough configured and dimensioned to enable movement of the game pieces through the passages so that the interposing member impedes access of the acquisition tool to at least those of the game pieces in the passages. A motor is provided for vibrating the interposing member.

10 Claims, 4 Drawing Sheets

ACOUISITION GAME

BACKGROUND OF THE INVENTION.

The present invention relates to games, and more particularly to an acquisition game in which each player seeks to acquire as many game pieces as possible in as short as time as possible.

The game art is replete with acquisition games in which players compete against one another in order to remove from a playing field as many game pieces as possible in as short a time as possible. In most of these, the excitement comes from the several players attempting to accomplish the same thing while actively interfering with the acquisition processes of their opponents. The game itself—that is, the acquisition process—may be easy or difficult, as desired for a particular game, but the structural elements of the game itself do not act as an opponent. In other words, the game does not act as an opponent actively interfering with the acquisition process of each player. Accordingly, the games are played mainly when there are a plurality of players, as there is little interest in a given player playing by himself a passive game.

Accordingly, it is an object of the present invention to provide an acquisition game having enhanced play value because the game itself appears to resist the efforts of a player to complete the acquisition process.

Another object is to provide such a game which lends itself to being played by a single player since the game itself acts as an adversary to the acquisition efforts of the player.

A further object is to provide such a game which is easy and economical to manufacture, sturdy in design and simple to play.

SUMMARY OF THE INVENTION

It has now been found that the above and related objects and advantages of the present invention are obtained in an acquisition game played on a concave playing field defining a nadir with a plurality of movable game pieces removably disposed on the field for movement thereabout. A plurality of acquisition means are provided for removing at least one of the game pieces at a time from the field, the acquisition means also being for moving the game pieces and an interposing member about the field. An interposing member is removably disposed on the field for movement thereabout when the interposing member vibrates, the interposing member being substantially greater in size than any of the game pieces and defining passages therethrough configured and dimensioned to enable movement of the game pieces through the passages so that the interposing member impedes access of the acquisition means to at least those of the game pieces in the passages. Means are also provided for vibrating the interposing member.

In a preferred embodiment, the field is configured and dimensioned such that movement of the game pieces and the interposing member is primarily towards the nadir of the field. The game pieces are rollable and preferably spherical. The interposing member is freely movable anywhere on the field and is also optionally used for removing the interposing member from the field at the end of the game. The interposing member is in the form of an animal defining a torso and legs supporting the torso spaced above the field, the passages being disposed under the animal torso and between the animal legs. The acquisition means is in the form of tweezers, and the means for vibrating is disposed in the interposing member.

BRIEF DESCRIPTION OF THE DRAWING

The above and related objects, features, and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
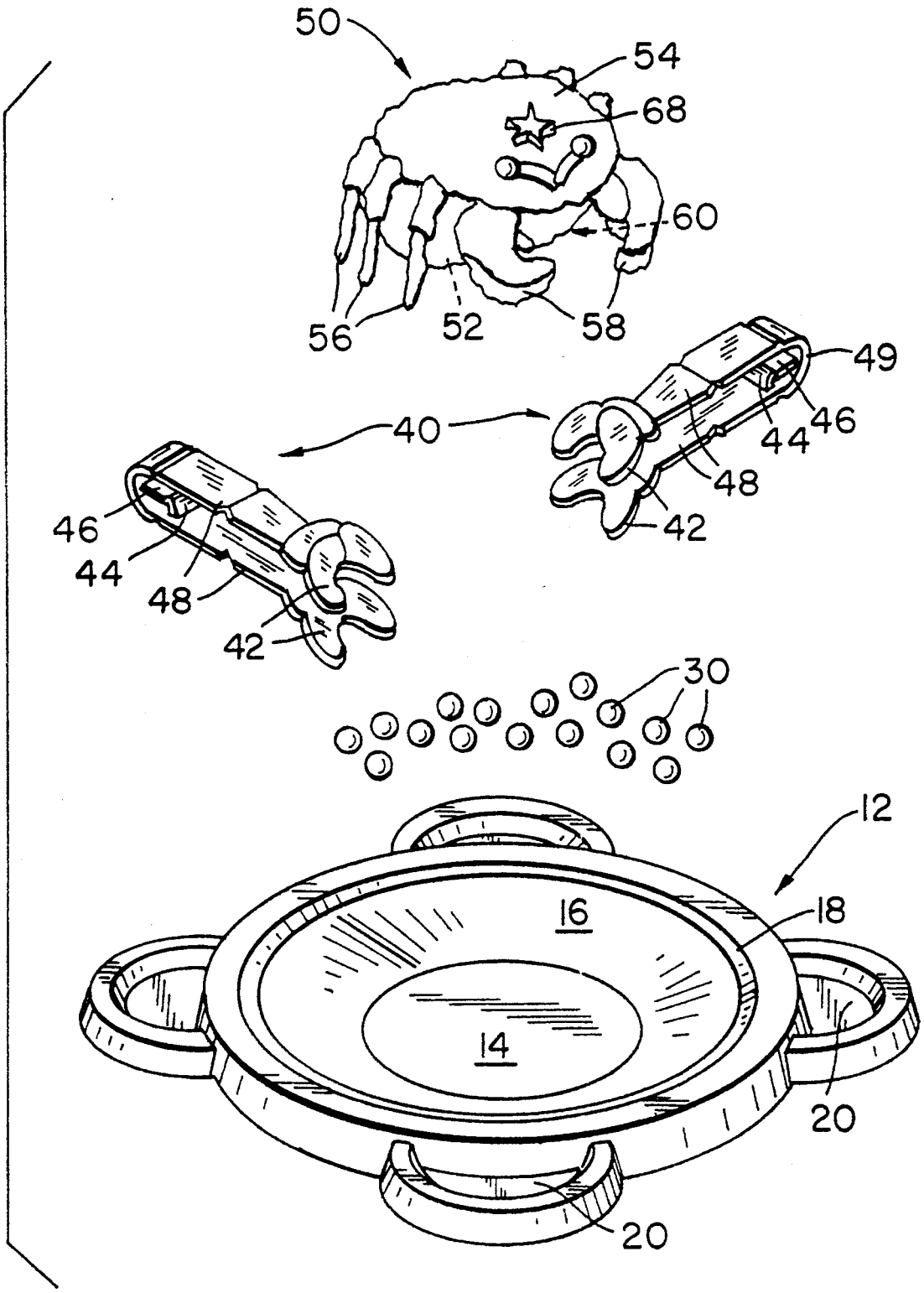
FIG. 1 is an exploded isometric view of a game according to the present invention.
Figure 2:
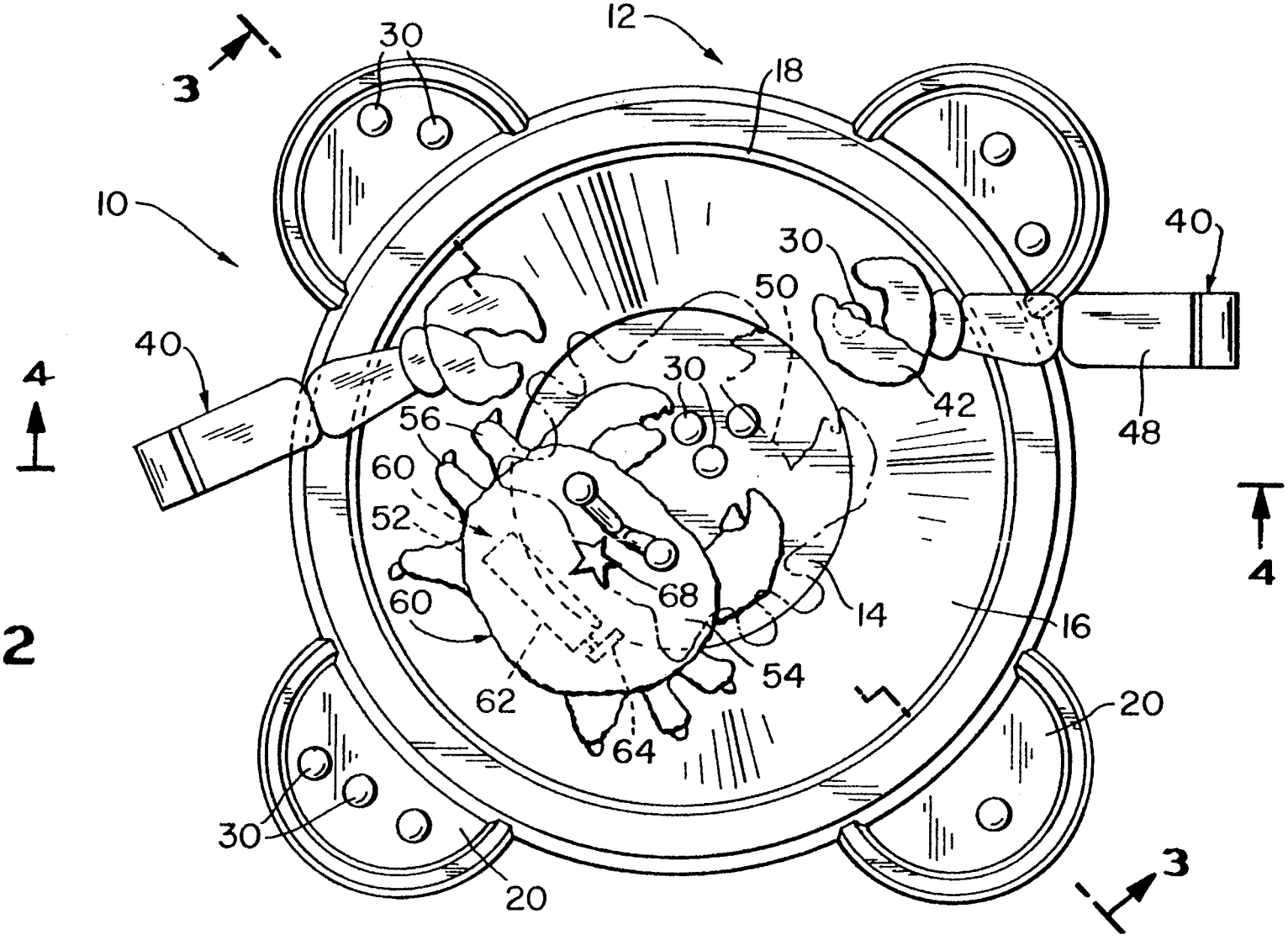
FIG. 2 is a top plan view thereof with the interposing member being illustrated in one position in solid line and another position in phantom line.

Referring now to the drawing, and in particular to FIGS. 1 and 2 thereof, therein illustrated is a game according to the present invention, generally designated by the reference numeral 10. While the game will be described hereinbelow in terms of a "Crazy Crab" game, the principles and structures of the game lend themselves to a variety of variants, for example, with the "crab" being replaced by a number of different multi-legged animals or other characters.

The game 10 is played on a generally concave or dish-like playing field, generally designated 12, which defines a low region or nadir 14, typically at the somewhat flattened center thereof. The upper surface 16 of the field 12 is preferably substantially smooth so as to facilitate the movement of objects thereover—e.g., the rolling of spherical objects (such as marbles) thereabout. The field 12 is preferably formed of molded plastic and adapted to be stably rested on a table top or the like. The field upper surface 16 defines an upstanding peripheral rim 18 to maintain game pieces placed on the field 12 on the field. The outer surface of the rim 18 preferably defines a plurality of outwardly extending pockets 20, typically one for each player, so that each player may deposit in his respective pocket 20 any game pieces which he acquires during the course of play. In keeping with the "Crazy Crab" theme of the game, the field upper surface 16 may be painted or otherwise decorated to resemble the ocean.

The game 10 additionally includes a plurality of movable game pieces 30 which are removably disposed on the field 12 for movement thereabout within the confines of the rim 18. The game pieces are preferably spherical in configuration to facilitate their rolling over the field upper surface 16 and are preferably marbles, but they may also be other rollable configurations such as cylinders, and the like. The game pieces 30 may also be low-friction discs which slide easily over the field upper surface 16. Preferably, in keeping with the "Crazy Crab" theme of the game, the game pieces are referred to as "fish" and, indeed, they may be surface treated (e.g., painted) to at least partially resemble fish. Due to the concavity of the field 12, the game pieces 30 tend to roll towards and congregate in and about the nadir 14 of the field upper surface 16.

Figure 3:
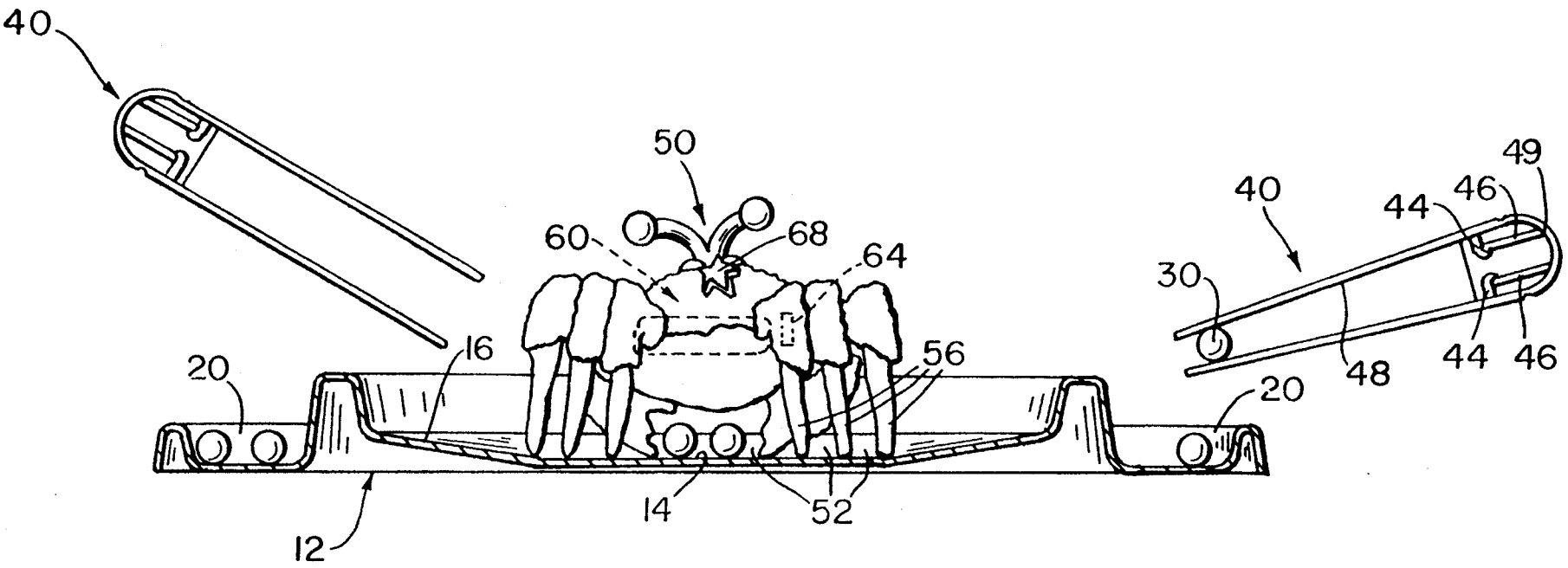
FIGS. 3 and 4 are sectional views taken along the lines 3—3 and 4—4, respectively, of FIG. 2.
Figure 4:
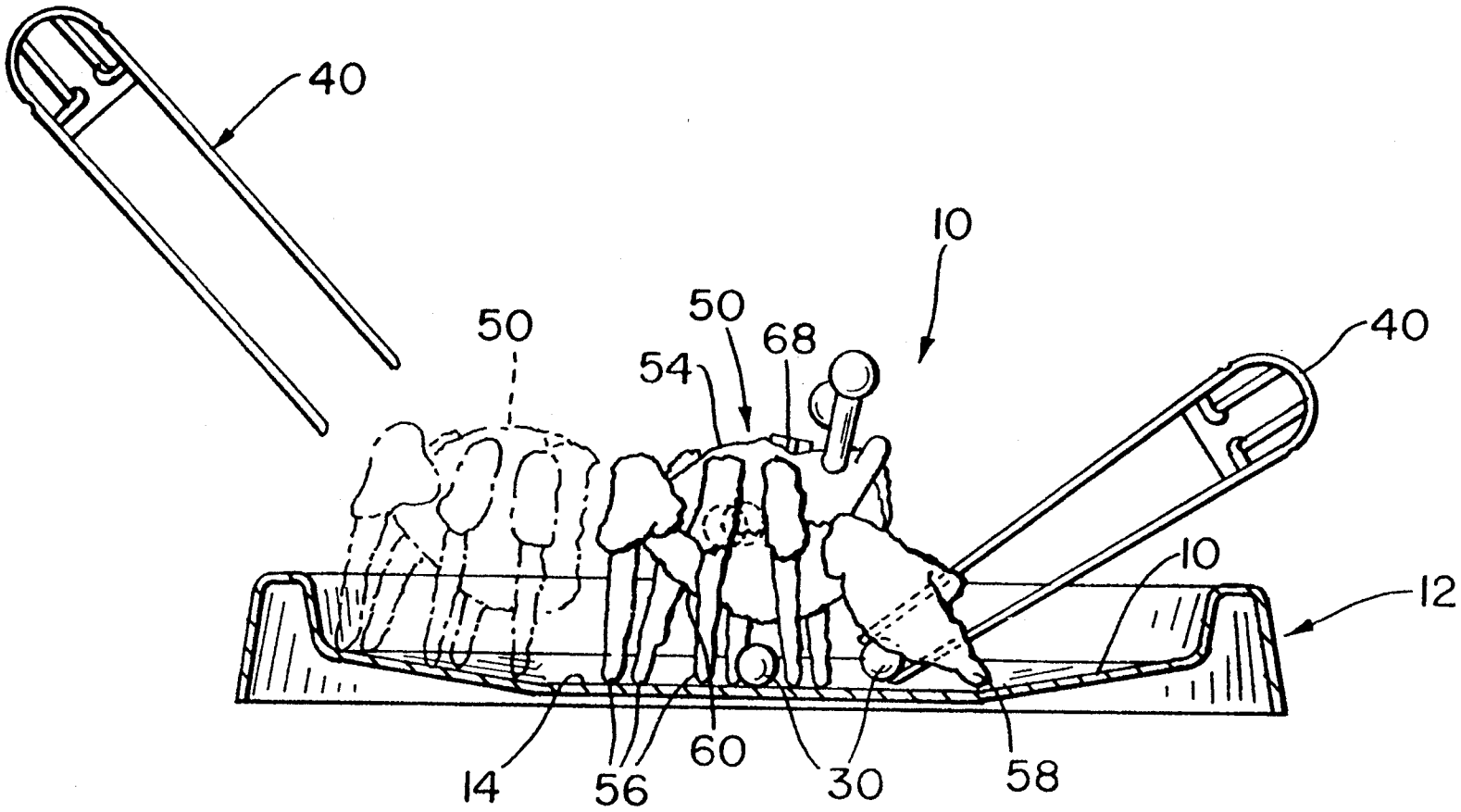

Each player is provided with acquisition means 40 for removing at least one of the game pieces 30 at a time from the field 12. Depending upon the particular implementation of the concept, the acquisition means 40 may enable the removal thereby of only one game piece 30 at a time from the field 12 or, with luck and skill, a plurality of game pieces 30 simultaneously. Each acquisition means 40 is preferably in the form of a pair of tweezers suitable for picking up either one or a plurality of the game pieces 30 at a time from the field, as best seen in FIGS. 3 and 4. In keeping with the "Crazy Crab" theme of the game 10, each acquisition means may be configured such that each free end 42 thereof resembles a crab claw. Thus each player has his own pair of crab claws 40 vying with the crab claws 40 of opposing players to grasp one of the "fish" game pieces 30 with sufficient security to enable removal of the game piece 30 from the field 12.

While a game piece 30 must be secured between the free ends 42 of an acquisition means 40 to enable removal of a game piece 30 from the field 12, all surfaces of the free ends 42 may be used for moving the game pieces 30 about the playing field 12, either to set up a game piece 30 for grasping and removal, or to interfere with an opposing player's attempt to remove the game piece 30. The acquisition means 40 is preferably formed of a plastic having the necessary resilience to act as a tweezer when appropriately configured. Each acquisition means 40 may be packaged in a flat form for shipment and sale and then bent over into tweezer configuration with the engaging means 44 on the legs 48 engaging the engaging means 46 projecting from the bight 49 to maintain the tweezer configuration while still permitting the legs 48 to be squeezed together.

Depending upon the variant of the game preferred (which may in turn depend upon the number of players involved in a particular game), each player may be given either one or two acquisition means 40. With two acquisition means 40, a player can use one acquisition means 40 to secure and remove a game piece 30 from the field 12 and the other acquisition means 40 to interfere with the attempts of an opponent to do the same with respect to either the same or another game piece 30. For expository purposes, only two acquisition means 40 are illustrated.

In a preferred embodiment of the present invention, an interposing member 50 is removably disposed on the upper surface 16 of the field 12 for movement thereabout. The interposing member 50 is substantially greater in size than any of the game pieces 30 and defines passages 52 therethrough configured and dimensioned to enable movement of the game pieces 30 through the passages 52. In keeping once again with the "Crazy Crab" theme of the game 10, the interposing member 50 is preferably in the form of an animal defining a torso 54 and a plurality of legs 56 supporting the torso 54 in a position spaced above the upper surface 16 of the field 12. Thus passages 52 for the game pieces 30 are disposed under the animal torso 54 and between the animal legs 56. More particularly, the interposing member 50 is preferably in the form of a crab defining a torso 54, six legs 56 and optionally a pair of claws 58. The claws 58 may or may not extend all the way down to the field upper surface 16 and thus may or may not play a role in supporting torso 54 thereabove. The interposing member 50 is freely movable anywhere on the field upper surface 16, but, like the game pieces 30, is restrained against movement therefrom by the rim 18.

The interposing member 50 impedes the acquisition process of each player. Game pieces 30 which are disposed within the passages 52 are not easily accessible by the acquisition means 40 of any player, and game pieces 30 which are disposed on the far side of the interposing member 50 relative to a given player are not easily accessible to the acquisition means 40 of that given player. In these instances, it may be necessary for a player to use his acquisition means 40 to move or nudge the interposing member 50 to a different position so as to enable access to the game pieces 30 which were previously in the passages 52 or on the far side of the interposing member 50. where a player has two acquisition means 40, he may use one of them to move the interposing member 50 out of the way so as to enable his other acquisition means to pick up and remove a game piece 30 from the field 12. As will be readily apparent to those skilled in the art, a passive interposing member 50 would add only a minor degree of play value to the game since it would quickly be moved by one or another of the players out of the area of the field where the game pieces 30 congregate—namely, the nadir 14. Accordingly, the interposing member 50 of the present invention is not passive, but active.

The interposing member 50 has disposed therein (but typically concealed by the crab carapace) means, generally designated 60, for vibrating the interposing member 50. The vibrating means 60 typically includes a motor 62 driving an eccentrically weighted fly-wheel 64, a power source such as a battery (not shown) for the motor 62, and an on-off switch 68 (optionally configured as a star fish on the carapace) for the motor 62. Under the influence of the vibrations caused by the vibrating means 60, the interposing means 50 will tend to move actively about the field upper surface 16. However, due to the concavity of the field upper surface 16, as illustrated in FIGS. 2 and 4 the interposing member 50 will tend to gravitate towards the field nadir 14 under the influence of gravity. It will be appreciated that, as both the interposing member 50 and the game pieces 30 are gravitating toward the field nadir 14, with the game pieces 30 entering and leaving the passages 52 of the interposing member 50, the vibrating interposing member 50 acts as an opponent player, actively frustrating the attempts of each player to acquire game pieces 30, sometimes favoring one player more than another and sometimes making the acquisition process more difficult for all players equally. The ability of the interposing member 50 to move about the field 12 on its own (i.e., actively) helps to create the image of an opponent player.

To play the game, the plurality of game pieces 30 and the interposing member 50 (after the latter is turned on using switch 68) are placed on the field upper surface 16 within the rim 18. Each player is equipped with at least one acquisition means 40 and uses the acquisition means 40 to move game pieces 30 and/or the interposing member 50 about the field 12 as necessary so as to eventually enable him to grasp a game piece 30 with the free ends 42 of his acquisition means 40, remove the game piece 30 from the field 12, and place the same in his pocket 20. The game may be terminated when the first player acquires a predetermined number of the game pieces 30 within his pocket 20. Alternatively, play of the game may continue for a fixed period of time, the winner being the person with the most game pieces 30 in his pocket 20 at the end of the game.

In a preferred embodiment of the game, the acquisition process is rendered more difficult by having the game pieces 30 of different colors, with each player allowed to remove only the game pieces 30 of the color assigned to that player. For example, there may be four players and ten game pieces 30 of each color, and the color assigned to a given player may be the color of his acquisition member 40. In this instance, the first player to pick up all of the game pieces 30 of his assigned color (i.e., the color of his acquisition member 40) would be the winner. In a variant of this, a player who acquires all of the game pieces 30 of his assigned color must then use his acquisition means 40 to remove from the field 12 the interposing member 50, the winner of the game being the person who removes the interposing member 50 from the field 12.

As noted above, while the present invention has been described in terms of a game 10 having a "Crazy Crab" theme, other themes may be employed. For example, in a "Crazy Anteater" theme game, the game pieces 30 may be ants, the interposing member 50 may be an anteater, and the acquisition means 40 may be a tongue capable of removing a game piece 30 from the playing field 12. Many game variations are possible, depending upon the theme selected. For example, in the "Crazy Anteater" game, each game piece may define a cylindrical aperture therethrough or at least a recess on the outer surface and the interposing member may define a projecting boss which is capable of entering the aperture or at least engaging the recess to enable removal of the game piece from the playing field.

To summarize, the present invention provides an acquisition game having enhanced play value because the game itself appears to resist the efforts of a player to complete the acquisition process and thereby acts as an opponent player. The games lends itself to being played by a single player since the game itself acts as an active adversary to the acquisition efforts of the player. The game is easy and economical to manufacture, sturdy in design and simple to play.

Now that the preferred embodiments of the present invention have been shown and described in various detail, various modifications and improvements thereon will become readily apparent to those skilled in the art. Accordingly, the spirit and scope of the present invention is to be construed broadly and limited only by the appended claims, and not by the foregoing specification.

We claim:

1. An acquisition game comprising:

(A) a generally concave playing field defining a nadir;

(B) a plurality of movable game pieces removably disposed on said field for movement thereabout;

(C) a plurality of acquisition means for removing at least one of said game pieces at a time from said field, said acquisition means also being for moving said game pieces and an interposing member about said field;

(D) an interposing member removably disposed on said field for movement thereabout when said interposing member vibrates, said interposing member being substantially greater in size than any of said game pieces and defining passages therethrough configured and dimensioned to enable movement of said game pieces through said passages so that said interposing member impedes access of said acquisition means to at least those of said game pieces in said passages; and (E) means for vibrating said interposing member.

2. The game of claim 1 wherein said field is configured and dimensioned such that movement of said game pieces and said interposing member is primarily towards said nadir of said field.

3. The game of claim 1 wherein said game pieces are rollable.

4. The game of claim 1 wherein said game pieces are spherical.

5. The game of claim 1 wherein said acquisition means is also for removing said interposing member from said field at the end of the game.

6. The game of claim 1 wherein said interposing member is freely movable anywhere on said field.

7. The game of claim 1 wherein said interposing member is in the form of an animal defining a torso and legs supporting said torso spaced above said field, said passages being disposed under said animal torso and between said animal legs.

8. The game of claim 1 wherein said acquisition means is in the form of tweezers.

9. The game of claim 1 wherein said means for vibrating is disposed in said interposing member.

10. An acquisition game comprising:

(A) a generally concave playing field defining a nadir;

(B) a plurality of spherical game pieces removably disposed on said field for movement thereabout;

(C) a plurality of acquisition means for removing at least one of said game pieces at a time from said field, said acquisition means also being for moving said game pieces and an interposing member about said field;

(D) an interposing member removably disposed on said field for movement thereabout when said interposing member vibrates, said interposing member being substantially greater in size than any of said game pieces and defining passages therethrough configured and dimensioned to enable movement of said game pieces through said passages so that said interposing member impedes access of said acquisition means to at least those of said game pieces in said passages, said interposing member being freely movable anywhere on said field, said interposing member being in the form of an animal defining a torso and legs supporting said torso spaced above said field, said passages being disposed under said animal torso and between said animal legs; and (E) means disposed in said interposing member for vibrating said interposing member;

said field being configured and dimensioned such that movement of said game pieces and said interposing member is primarily towards said nadir of said field, and said acquisition means also being for removing said interposing member from said field at the end of the game.

* * * * *